US008237093B2

(12) United States Patent
Huang

(10) Patent No.: US 8,237,093 B2
(45) Date of Patent: Aug. 7, 2012

(54) POWER SUPPLY DEVICE HAVING FUNCTION OF HEATING

(75) Inventor: Wen-Hung Huang, Taipei County (TW)

(73) Assignee: Hannspree, Inc., New Taipei (TW)

( * ) Notice: Subject to any disclaimer, the term of this patent is extended or adjusted under 35 U.S.C. 154(b) by 451 days.

(21) Appl. No.: 12/638,341

(22) Filed: Dec. 15, 2009

(65) Prior Publication Data

US 2011/0089157 A1 Apr. 21, 2011

(30) Foreign Application Priority Data

Oct. 21, 2009 (TW) ..... 98135575 A

(51) Int. Cl.
*H05B 3/68* (2006.01)

(52) U.S. Cl. ..... 219/443.1; 219/209; 219/240; 219/406; 219/414; 219/482

(58) Field of Classification Search ..... 219/209, 219/240, 245, 406, 414, 443.1, 482
See application file for complete search history.

(56) References Cited

U.S. PATENT DOCUMENTS 4,081,737 A * 3/1978 Miyahara ..... 320/107
2009/0101632 A1* 4/2009 Naylor ..... 219/202

* cited by examiner

*Primary Examiner* — Angel Roman
(74) *Attorney, Agent, or Firm* — Muncy, Geissler, Olds & Lowe, PLLC

(57) ABSTRACT

A power supply device having function of heating includes a body, a circuit board, and a heating plate. An accommodation space is defined in the body. The circuit board is disposed in the accommodation space. An input connector and an output connector are disposed on the circuit board. The circuit board receives an external power via the input connector, selectively transforms the external power into a first output power or a second output power, and outputs the first output power via the output connector. The heating plate is disposed on a bottom side of the body and electrically connected to the circuit board to receive the second output power to generate heat for increasing the temperature thereof. The thermal insulator is disposed between the circuit board and the heating plate for isolating heat transferred from the heating plate to the circuit board.

11 Claims, 6 Drawing Sheets

POWER SUPPLY DEVICE HAVING FUNCTION OF HEATING

CROSS-REFERENCES TO RELATED APPLICATIONS

This non-provisional application claims priority under 35 U.S.C. §119(a) on Patent Application No. 98135575 filed in Taiwan, R.O.C. on Oct. 21, 2009, the entire contents of which are hereby incorporated by reference.

BACKGROUND

1. Technical Field

The present invention relates to an external power supply device for an electronic device, and more particularly to a power supply device having function of heating.

2. Related Art

An electric power for a portable electronic device such as notebook computer can be selectively supplied by an internal power source or an external power source. The internal power source is a battery, such as a rechargeable battery, which is used for providing direct current (DC) power directly to the portable electronic device. The external power source is a power supply device with rectification and voltage transforming functions. The power supply device receives an alternating current (AC) power from an AC socket. Through rectification and voltage transformation, the AC power is transformed into DC power. The DC power is then provided to the portable electronic device and may charge the battery as an internal power source. An electrical capacity of the rechargeable battery is limited. When the AC power is available, a user can use the power supply device to provide the power required for the use of the portable electronic device.

In order to ensure that the user can use the portable electronic device when the user leaves their home or on the road, the user usually takes the power supply device with him/her. For example, when the user carries a notebook computer on a business trip, the user will certainly also take a power supply device for the notebook computer. As most power supply devices have certain weights and volumes, which can occupy certain luggage space, and as a result certain daily necessities cannot be accommodated in a suitcase, resulting in inconvenience when traveling.

SUMMARY

A power supply device occupies certain luggage space, such that the user must sacrifice other household daily necessities or having the hassle of carrying heavy luggage.

In view of abovementioned problems, the present invention provides a power supply device having function of heating. The power supply device of the present invention not only supplies an electric power to a portable electronic device, but also provides a heating function to replace electric heating utensils such as an iron, thus replacing the number of daily necessities to be brought on a trip.

The present invention provides a power supply device having function of heating, which includes a body, a circuit board, a heating plate, and a thermal insulator. The body has an accommodation space. The circuit board is disposed in the accommodation space of the body. An input connector and an output connector are disposed on the circuit board. The circuit board receives an external power via the input connector, and selectively transforms the external power into a first output power or a second output power. The circuit board outputs the first output power via the output connector. The heating plate is disposed on a bottom side of the body and is electrically connected to the circuit board. The heating plate receives the second output power to generate heat for increasing the temperature thereof. The thermal insulator is located between the circuit board and the heating plate, which is used for isolating heat generated by the heating plate and preventing the heat from being conducted to the circuit board.

The external power is selectively transformed into a first output power or a second output power through the circuit board. The power supply device can be used to output the first output power to a portable electronic device directly, output the second output power to drive the heating plate to generate heat. Therefore, the power supply device according to the present invention not only outputs an electric power, but also achieves a heating function to replace electric heating appliances, for example, an iron, such that the user can avoid the trouble of bringing too many household appliances.

DETAILED DESCRIPTION

Figure 1:
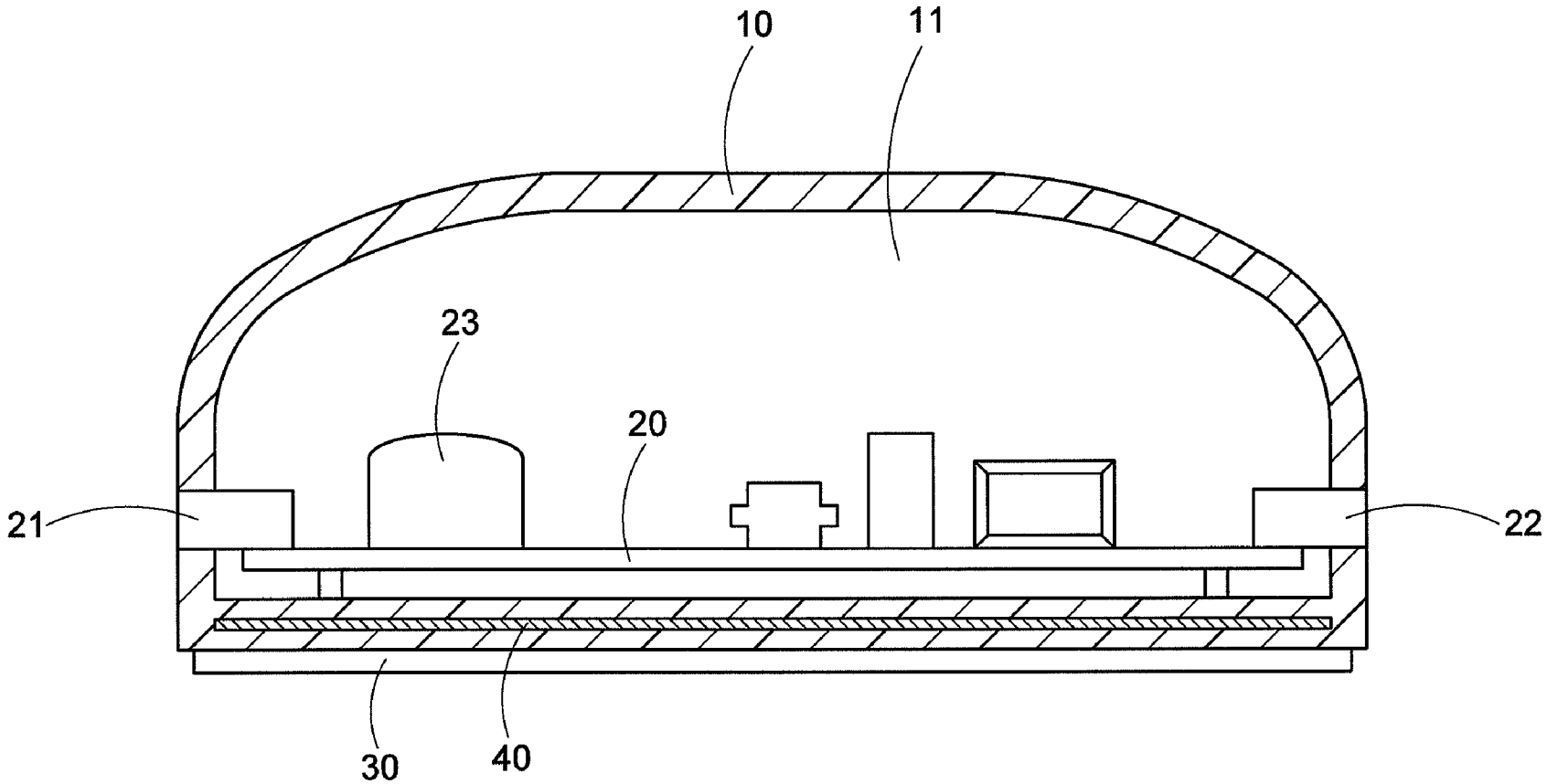
FIG. 1 is a cross-sectional view according to a first embodiment of the present invention.
Figure 2:
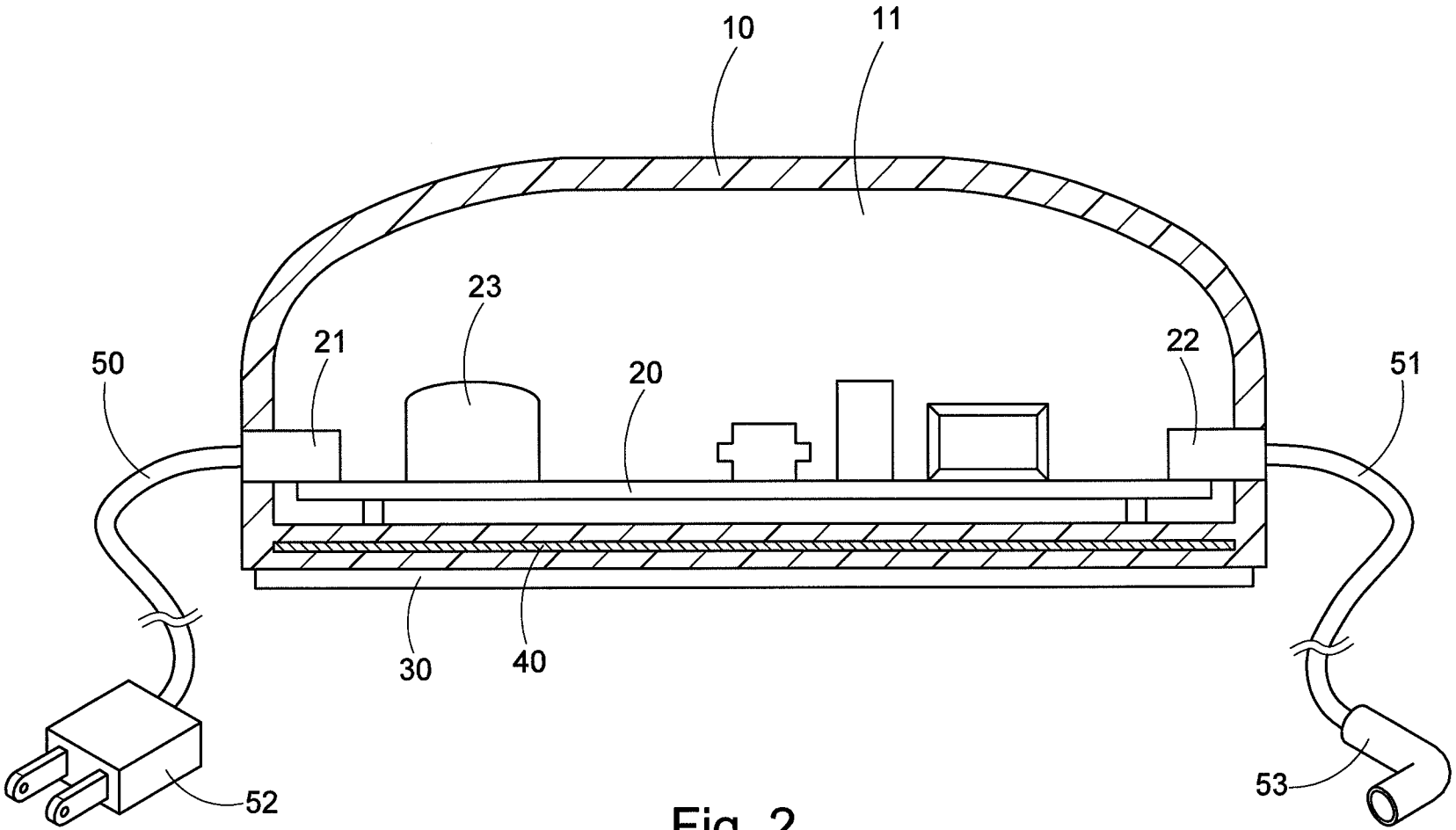
FIG. 2 is a cross-sectional view according to the first embodiment of the present invention, in which a power output cable and a power input cable are connected to an output connector and an input connector respectively.

Referring to FIGS. 1 and 2, a power supply device having function of heating according to an embodiment of the present invention is provided, which includes a body 10, a circuit board 20, a heating plate 30, and a thermal insulator 40.

Referring to FIGS. 1 and 2, the body 10 has an accommodation space 11. The accommodation space 11 is used to accommodate other components of the power supply device. In general, the body 10 is made of electrical insulation material such as plastic. One side of the body 10 is preferably in a shape of curve surface, but the present invention is not limited thereto.

Referring to FIGS. 1 and 2, the circuit board 20 is disposed in the accommodation space 11 of the body 10 and is wrapped and protected by the body 10 without being exposed to external environment. An input connector 21 and an output connector 22 are disposed on the circuit board 20. The input connector 21 and the output connector 22 are disposed at each end of the circuit board 20 respectively. Moreover, the circuit board 20 has a voltage conversion device 23 disposed thereon to selectively transform an external power into a first output power or a second output power.

Referring to FIG. 2, in which the power supply device having function of heating according to the present invention further includes a power input cable 50 and a power output cable 51. One end of the power input cable 50 is connected to the input connector 21, and the other end thereof is disposed with a first power jack 52. Here, the first power jack 52 is preferably a household power plug for being inserted in a household power source, so as to receive the external power. However, the first power jack 52 according to the present invention is not limited to the household power plug. Through the first power jack 52 and the power input cable 50, the input connector 21 of the circuit board 20 receives an external power. One end of the power output cable 51 is detachably connected to the output connector 22, and the other end thereof is disposed with a second power jack 53. Here, the second power jack 53 is preferably a DC jack, which is used for being connected to a power connector of a portable electronic device, such that the voltage conversion device 23 of the circuit board 20 transforms the external AC power received from input connector 21 and outputs as first output power such as DC power through output connector 22. This provides power to the portable electronic device.

Referring to FIGS. 1 and 2, the heating plate 30 is substantially rectangular, disposed on a bottom side of the body 10, and electrically connected to the circuit board 20, which is used for receiving the second output power to increase the temperature of the heating plate 30. In general, the heating plate 30 is made of a material with desirable heat conductivity, for example, a metal plate. Heating coils are wrapped inside the heating plate 30, such that the temperature can be evenly and rapidly distributed within the heating plate 30.

Referring to FIGS. 1 and 2, the thermal insulator 40 is preferably a rectangular member located between the circuit board 20 and the heating plate 30, which is used for isolating heat generated by the heating plate 30 and preventing the heat from being conducted to the circuit board 20, so as to avoid the heating plate 30 from damaging the circuit board 20. In general, the thermal insulator 40 is made of a material with a low heat conductivity coefficient (high thermal resistance). The thermal insulator 40 may be embedded in a solid part of the body 10, and the heating plate 30 is disposed on the bottom side of the body 10 corresponding to the thermal insulator 40, as shown in FIGS. 1 and 2. Or, the thermal insulator 40 may be disposed in the accommodation space 11 and fixed to an internal surface of the body 10, such that the thermal insulator 40 and the heating plate 30 are separated by the solid part of the body 10, and the thermal insulator 40 is located between the circuit board 20 and the heating plate 30. Alternatively, the thermal insulator 40 may be fixed on a bottom side of the body 10, and the heating plate 30 is fixed on the thermal insulator 40, such that the heating plate 30 is disposed on the bottom side of the body 30, and the thermal insulator 40 is located between the circuit board 20 and the heating plate 30.

Figure 3A:
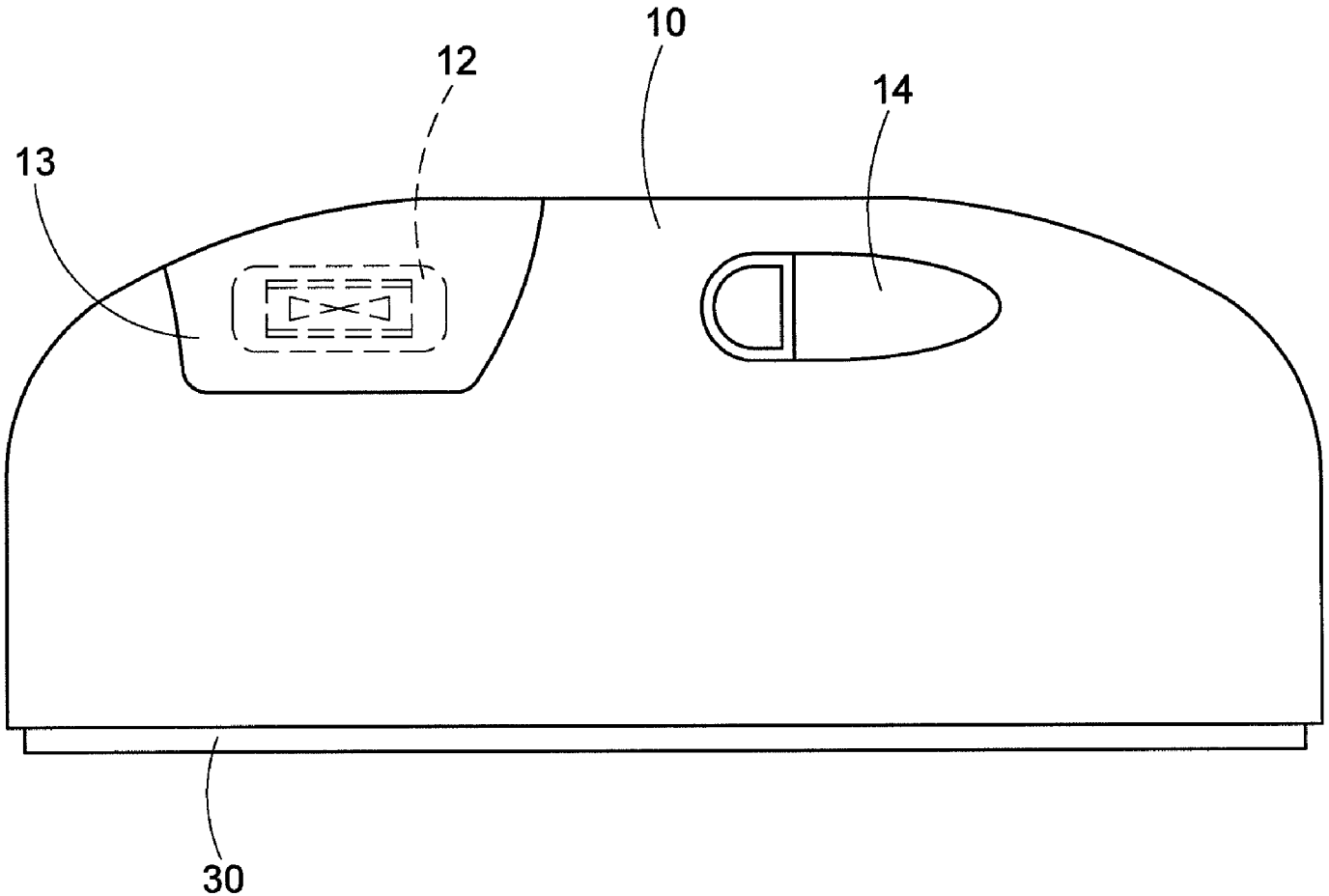
FIG. 3A is a side view according to the first embodiment of the present invention, in which a protective cover covers a switch.
Figure 3B:
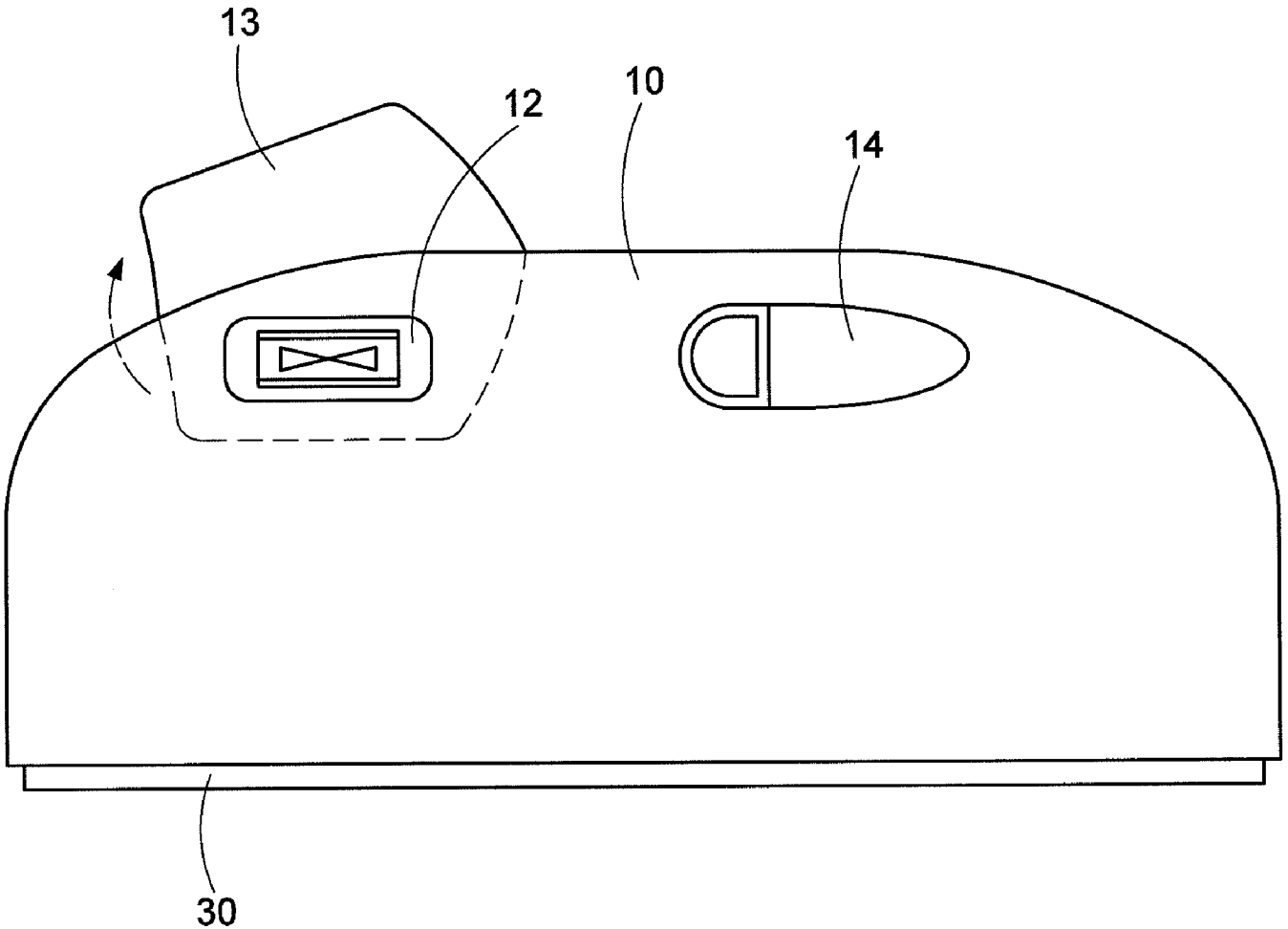
FIG. 3B is a side view according to the first embodiment of the present invention, in which the protective cover is opened to expose the switch.

Referring to FIGS. 3A and 3B, the power supply device having function of heating further has a switch 12 disposed on an outer surface of the body 10 and electrically connected to the circuit board 20. The switch 12 is used for switching the voltage conversion device 23 of the circuit board 20 to output or stop outputting the second output power to the heating plate 30. At the same time, when the voltage conversion device 23 stops outputting the second output power to the heating plate 30, the voltage conversion device 23 outputs the first output power to the output connector 22.

Referring to FIGS. 3A and 3B, the power supply device having function of heating further has a switch cover 13, which is movably disposed on the body 10 and selectively covers the switch 12, such that the switch 12 is disposed inside the switch cover 13 to prevent it being switch on by mistake.

Figure 4:
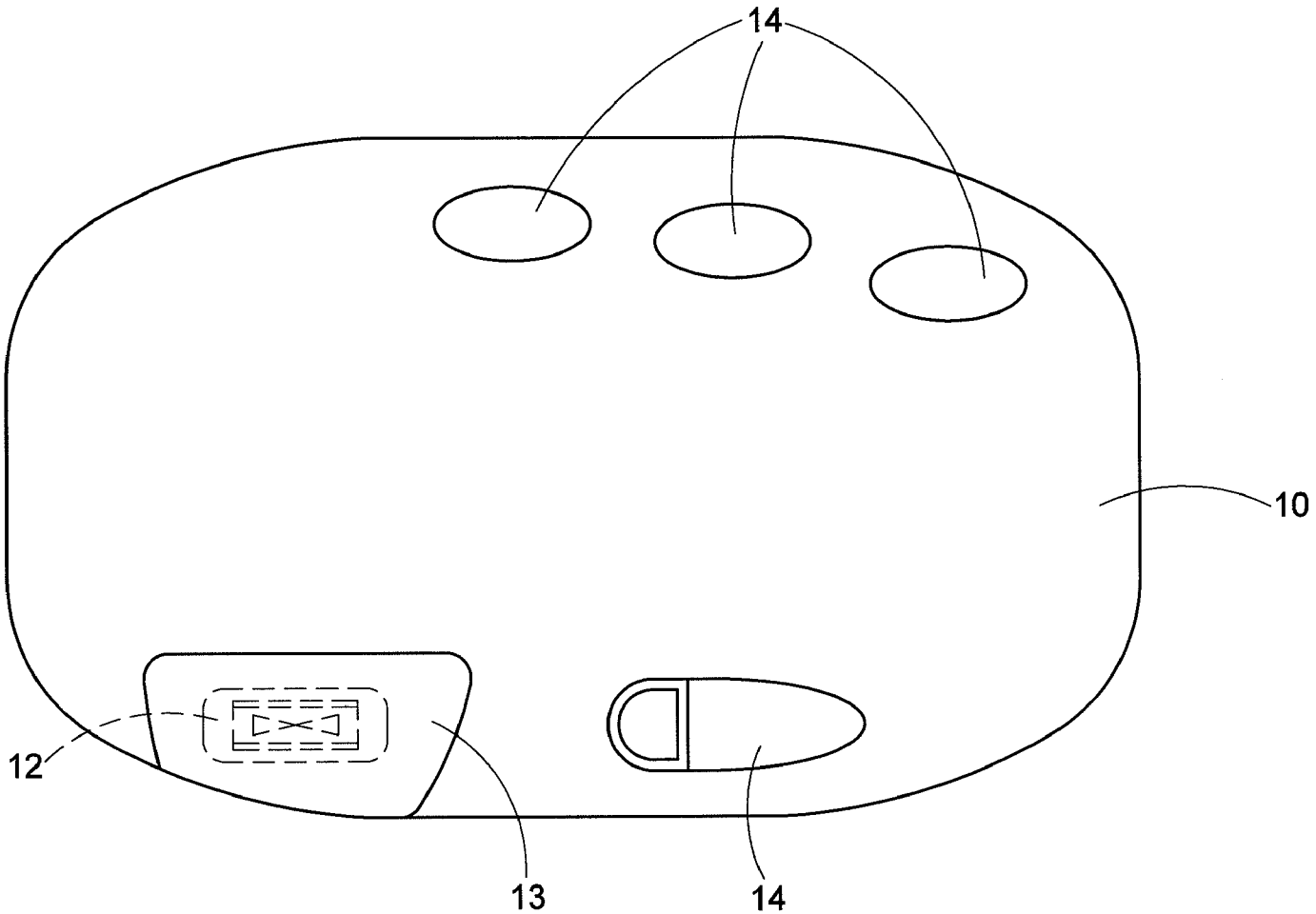
FIG. 4 is a top view according to the first embodiment of the present invention.

Referring to FIGS. 3A, 3B, and 4, the body 10 includes a holding part 14 located on the outer surface of the body 10. The holding part 14 includes a plurality of recesses with which the user may hold the body 10. However, the holding part 14 of the present invention is not limited to a plurality of recesses. The holding part 14 may be a single circular recess or a plurality of strip-shaped grooves.

Figure 5:
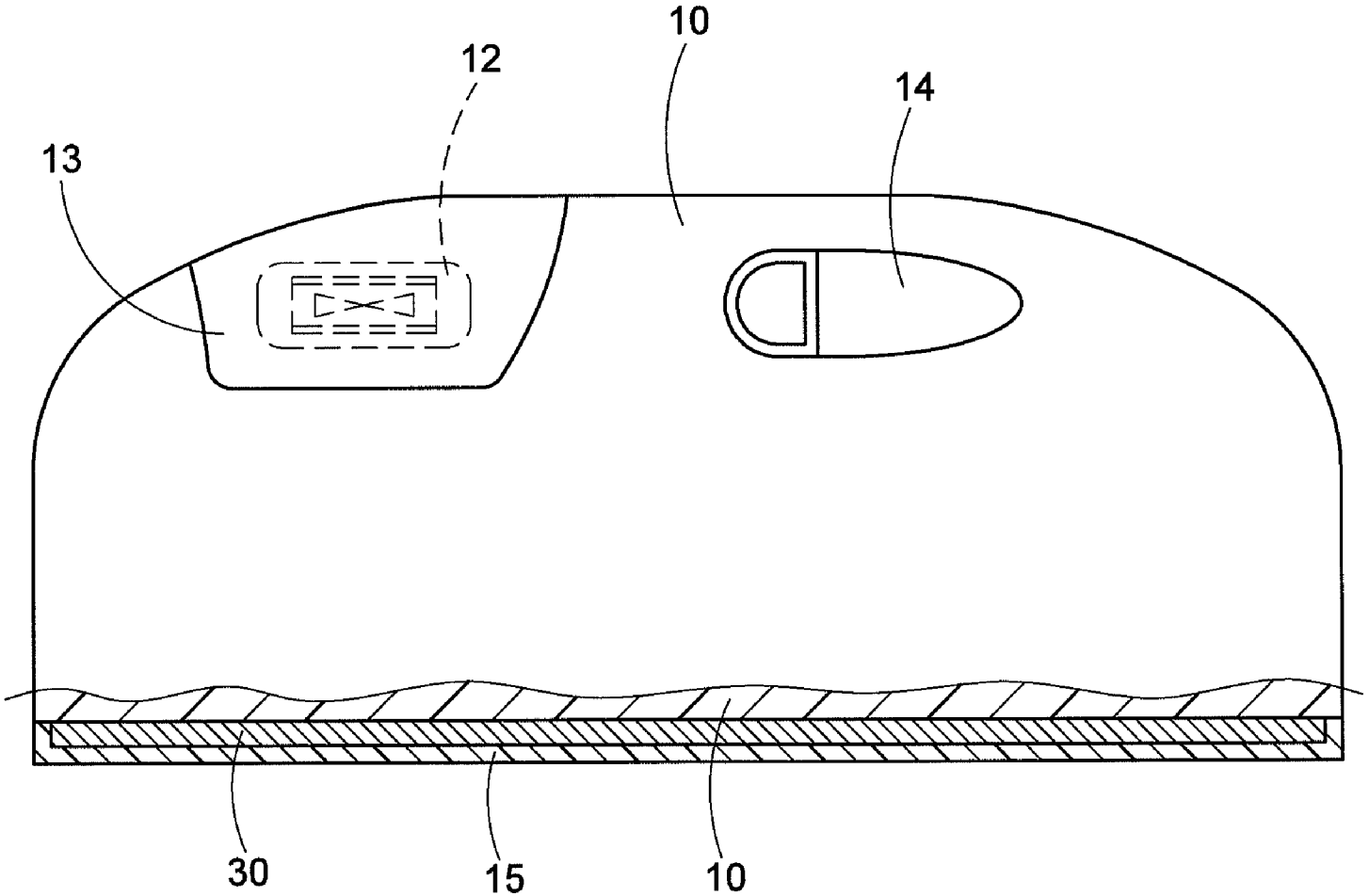
FIG. 5 is a side view according to the first embodiment of the present invention, including a partial cross-sectional view, which shows a heat shield cover.

Referring to FIG. 5, in which the power supply device having function of heating further includes a protective cover 15, which is detachably combined with the body 10 and used for covering the heating plate 30, so as to prevent the user from being burnt by the heating plate 30 when the heating plate 30 is not completely cooled to room temperature.

Referring to FIG. 2, when the user uses the power supply device of the present invention, one end of the power input cable 50 is connected to the input connector 21 and the first power jack 52 at the other end is plugged to a AC socket to receive the external power, such that the external power is transferred through the power input cable 50, and meanwhile the input connector 21 receives the external power and then transfers the external power to the circuit board 20.

The switch 12 is provided for the user to switch the circuit board 20 to output the first output power or the second output power. When the external power is input to the circuit board 20, the user first opens the switch cover 13 and then presses the switch 12, so as to control the voltage conversion device 23 to transform the external power into the first output power or the second output power. Subsequently, the switch cover 13 is closed, so as to prevent the switch 12 from being touched by mistake. When it is switched to the first output power, the circuit board 20 outputs the first output power through the output connector 22. Accordingly, one end of the power output cable 51 is connected to the output connector 22. Thereafter, the first output power flows through the power output cable 51, and the second power jack 53 supplies the first output power to the portable electronic device.

When the user intends to use the heating plate 30, the user takes off the protective cover 15, opens the switch cover 13, and presses the switch 12, so as to switch the voltage conversion device 23 to transform the external power into the second output power. At this time, the second output power is transferred to the heating plate 30 through the circuit board 20. Through the second output power, the heating plate 30 generates heat to increase temperature of the heating plate 30. In addition, the holding part 14 is disposed on the surface of the body 10 for the user to hold the body 10. When the heating plate 30 is heated to a predetermined temperature, the user first closes the switch cover 13 and the switch 12 situated inside the switch cover 13, so as to avoid touching the switch 12 by mistake. At the same time, the user holds the holding part 14 and moves the heating plate 30 to contact other objects that need to be ironed. The power output cable 51 may also be detached from the output connector 22, so as to prevent the power output cable 51 from interfering with the use of the heating plate 30 by the user.

After the operation of the heating plate 30 has been stopped, the heating plate 30 still consist heat and the temperature of the heating plate 30 can be high enough to cause injury. In order to prevent the heating plate 30 from causing injuries or hurting the user, the protective cover 15 is made to be combined with the body 10, so as to cover the heating plate 30, such that the heating plate 30 is not exposed, preventing the user from being injured by high temperature.

In the present invention, the heating plate 30 is combined with the circuit board 20, and the voltage conversion device 23 is used to transform the external power into the first output power or the second output power. Next, the switch 12 is used to selectively switch the voltage conversion device 23 of the circuit 20 to output the first output power or the second output power to the heating plate 30, such that the heating plate 30 is heated to a high temperature to iron objects. By means of the present invention, the trouble of carrying too many objects is reduced. The present invention also has dual functions, saving the user money which would otherwise be spent on more objects.

While the present invention has been described by the way of example and in terms of the preferred embodiments, it is to be understood that the invention need not to be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A power supply device having function of heating, comprising:

a body, having an accommodation space;

a circuit board, disposed in the accommodation space of the body, and an input connector and an output connector being disposed on the circuit board; the circuit board receiving an external power from the input connector, selectively transforming the external power into a first output power or a second output power, and outputting the first output power via the output connector; and a heating plate, disposed on a bottom side of the body and electrically connected to the circuit board for receiving the second output power to generate heat for raising a temperature of the heating plate.

2. The power supply device having function of heating according to claim 1, further comprising a thermal insulator located between the circuit board and the heating plate, for isolating heat generated by the heating plate and preventing the heat from being conducted to the circuit board.

3. The power supply device having function of heating according to claim 1, further comprising an power input cable having one end connected to the input connector, and the other end equipped with a first power jack for receiving the external power.

4. The power supply device having function of heating according to claim 3, wherein the first power jack is a household power plug.

5. The power supply device having function of heating according to claim 1, wherein the circuit board further comprises a voltage conversion device for transforming the external power into the first output power or the second output power.

6. The power supply device having function of heating according to claim 1, further comprising an power output cable having one end connected to the output connector, and the other end equipped with a second power jack for outputting the first output power.

7. The power supply device having function of heating according to claim 6, wherein the second power jack is a direct current power jack.

8. The power supply device having function of heating according to claim 1, further comprising a switch disposed on the body and electrically connected to the circuit board, for switching the circuit board to output the first output power or the second output power.

9. The power supply device having function of heating according to claim 8, further comprising a switch cover movably disposed on the body to selectively cover the switch.

10. The power supply device having function of heating according to claim 1, wherein the body further comprises a holding part for a user to hold the body.

11. The power supply device having function of heating according to claim 1, further comprising a protective cover detachably combined with the body to cover the heating plate.

* * * * *